US010710264B2

(12) United States Patent
Falakos

(10) Patent No.: US 10,710,264 B2
(45) Date of Patent: Jul. 14, 2020

(54) SLAB SEVERING OR DIVIDING DEVICE AND METHOD

(71) Applicant: Kitchenworks Corporation, Barrington, IL (US)

(72) Inventor: Constantine M Falakos, Orland Park, IL (US)

(73) Assignee: Kitchenworks Corporation, Barrington, IL (US)

( * ) Notice: Subject to any disclaimer, the term of this patent is extended or adjusted under 35 U.S.C. 154(b) by 0 days.

(21) Appl. No.: 16/121,347

(22) Filed: Sep. 4, 2018

(65) Prior Publication Data

US 2019/0070743 A1 Mar. 7, 2019

Related U.S. Application Data

(63) Continuation of application No. 15/354,228, filed on Nov. 17, 2016, now abandoned.

(60) Provisional application No. 62/279,314, filed on Jan. 15, 2016.

(51) Int. Cl.
*B26D 7/26* (2006.01)
*B26B 3/00* (2006.01)

(52) U.S. Cl.
CPC ..... *B26D 7/2614* (2013.01); *B26B 3/00* (2013.01); *B26D 2210/02* (2013.01)

(58) Field of Classification Search
CPC ..... B26D 7/2614; B26D 2210/02; B26B 3/00
See application file for complete search history.

(56) References Cited

U.S. PATENT DOCUMENTS 1,491,623 A * 4/1924 Pitchur ..... A47G 21/14 30/295
4,094,221 A * 6/1978 Jacoby ..... B26B 29/063 83/34
4,355,745 A * 10/1982 Nelson ..... A47G 25/82 223/118

(Continued)

OTHER PUBLICATIONS

"Range® Meat Academy Butcher Tools" (Available at https://www.youtube.com/watch?v=aTONJ2KYYSg&t=137s (Year: 2018).*

(Continued)

*Primary Examiner* — Sean M Michalski
(74) *Attorney, Agent, or Firm* — Erickson Law Group, PC

(57) ABSTRACT

A severing device and method is effective to sever a portion from a frozen slab of fish or meat. The severing device can be sized to be useful in a domestic kitchen, and can be stored in a kitchen drawer when not in use. The severing device can be an elongated severing device, having an inverted Y-shaped cross section, which provides a raised separating edge and a two legged base. The separating edge can be relatively sharp. The two legs that make up the base can likewise be sharp such that any of the three legs that make up the inverted Y shape can be used as the raised edge, by rotating the severing device. Alternately the severing device can have a triangular cross section or an inverted T-shaped cross section. Also, alternately, the severing device can comprise a stand. The stand includes a base plate supporting a holder. The holder includes a vertical wall having an elongated slot. A cleaver or knife has a blade with a sharpened edge, and a handle. The cleaver is placed edge-up into the slot. Frozen slabs can then be placed over the edge and pressed down to be severed.

20 Claims, 3 Drawing Sheets

(56) References Cited

U.S. PATENT DOCUMENTS 4,740,023 A * 4/1988 Miller ..... B66C 1/585 294/15
4,846,690 A * 7/1989 Williams ..... B63B 35/81 434/253
4,989,123 A * 1/1991 Best ..... A45B 3/04 135/16
6,176,017 B1 * 1/2001 Sato ..... B26B 7/005 30/277.4
6,561,119 B1 * 5/2003 Rigitano ..... G08G 1/09 116/173
6,659,406 B2 * 12/2003 Tsuchida ..... A47G 21/14 211/70.7
D539,086 S * 3/2007 Aston, III ..... D7/401.2
7,441,659 B2 * 10/2008 Nelson ..... A47G 21/14 206/553
8,584,365 B2 * 11/2013 Zeitlin ..... B26B 11/00 30/123
9,446,532 B2 * 9/2016 Nasrallah ..... B26B 11/00
D795,639 S * 8/2017 Singer ..... D7/401.2
2004/0010923 A1 * 1/2004 Guiver ..... B26B 29/06 30/233
2006/0053630 A1 * 3/2006 White ..... B23D 51/02 30/151
2007/0039990 A1 * 2/2007 Kemmerer ..... B28D 5/0011 225/2
2010/0307008 A1 * 12/2010 Zeitlin ..... B26B 11/00 30/128
2012/0066914 A1 * 3/2012 Hayes ..... B26B 3/00 30/312
2012/0222312 A1 * 9/2012 Bordas ..... A47J 17/02 30/123.6
2017/0100848 A1 * 4/2017 Berthelette ..... A47J 47/005
2017/0203459 A1 * 7/2017 Falakos ..... B26D 7/2614

OTHER PUBLICATIONS

Tuna Processing After Harvest—Tuna Frozen, Cleaning, Cutting, Processing and Packing in Factory Available at (https://www.youtube.com/watch?v=0jdWiy7N2ok (Year: 2018).*

* cited by examiner

FIG 3
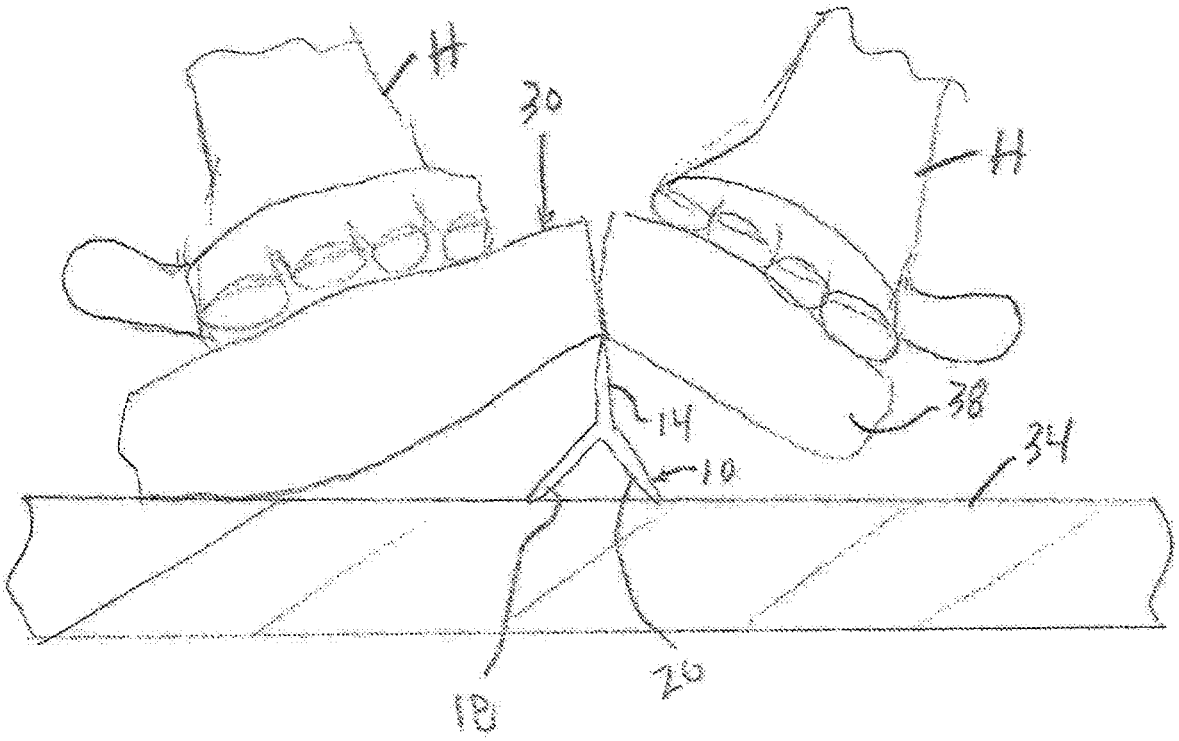
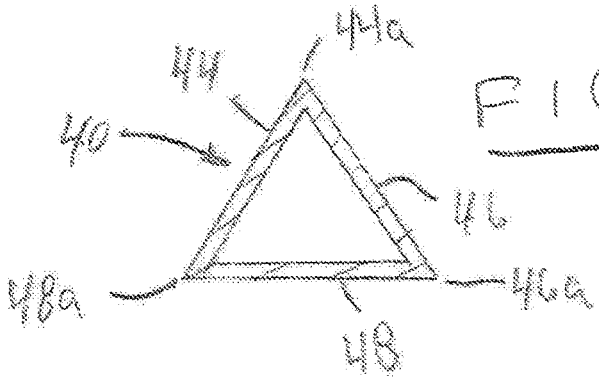
FIG 4
FIG 5
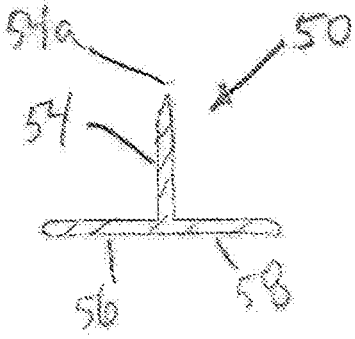

SLAB SEVERING OR DIVIDING DEVICE AND METHOD

This application is a continuation of U.S. Ser. No. 15/354,228, filed Nov. 17, 2016 which claims the benefit of U.S. Provisional Application No. 62/279,314, filed Jan. 15, 2016.

BACKGROUND

The invention relates to kitchen tools, particularly tools to sever or divide portions from slabs, such as fish or meat slabs.

It is known to provide a meat cleaver for severing portions from meat or fish. However, using a meat cleaver to sever a portion of frozen meat or fish is difficult.

The present inventor has recognized that it would be desirable to provide a useful tool to allow a user to sever a portion from a frozen slab such as a slab of frozen meat or fish. The present inventor has recognized that it would be desirable to provide such a tool that was safe to use, effective, convenient, rugged and long lasting. The present inventor has recognized that it would be desirable to provide a tool that allowed the user to separate or sever off a small portion of a frozen slab of meat or fish without the need to thaw the entire frozen slab before severing.

SUMMARY

An exemplary embodiment of the invention provides a severing or dividing device that is effective to sever a portion from a frozen slab of fish or meat. The exemplary embodiment is sized to be useful in a domestic kitchen, and can be stored in a kitchen drawer when not in use.

The exemplary embodiment comprises an elongated severing device, having an inverted Y-shaped cross section, which provides a raised separating edge and a two legged base. The separating edge can be relatively sharp. The two legs that make up the base can likewise be sharp such that any of the three legs that make up the inverted Y shape can be used as the raised edge, by rotating the severing device. Alternately, the separating edge can be comprised of parallel edges separated by a trough or groove. This configuration may be more effective in preventing slipping of the slab on the device.

Alternately the severing device can have a triangular cross section or an inverted T-shaped cross section.

Also, alternately, the severing device can comprise a stand. The stand includes a base plate supporting a holder. The holder includes a vertical wall having an elongated slot. A cleaver or knife has a blade with a sharpened edge, and a handle. The cleaver is placed edge-up into the slot. Frozen slabs can then be placed over the edge and pressed down to be severed. The cleaver can be conveniently washed, maintained, sharpened or replaced, separate from the stand.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 3 is an end view showing the severing device used in severing a portion from a frozen slab;

FIG. 4 is a sectional view of an alternate embodiment severing device to that shown in FIG. 2;

FIG. 5 is a sectional view of a further alternate severing device to that shown in FIG. 2;

DETAILED DESCRIPTION

Figure 1:
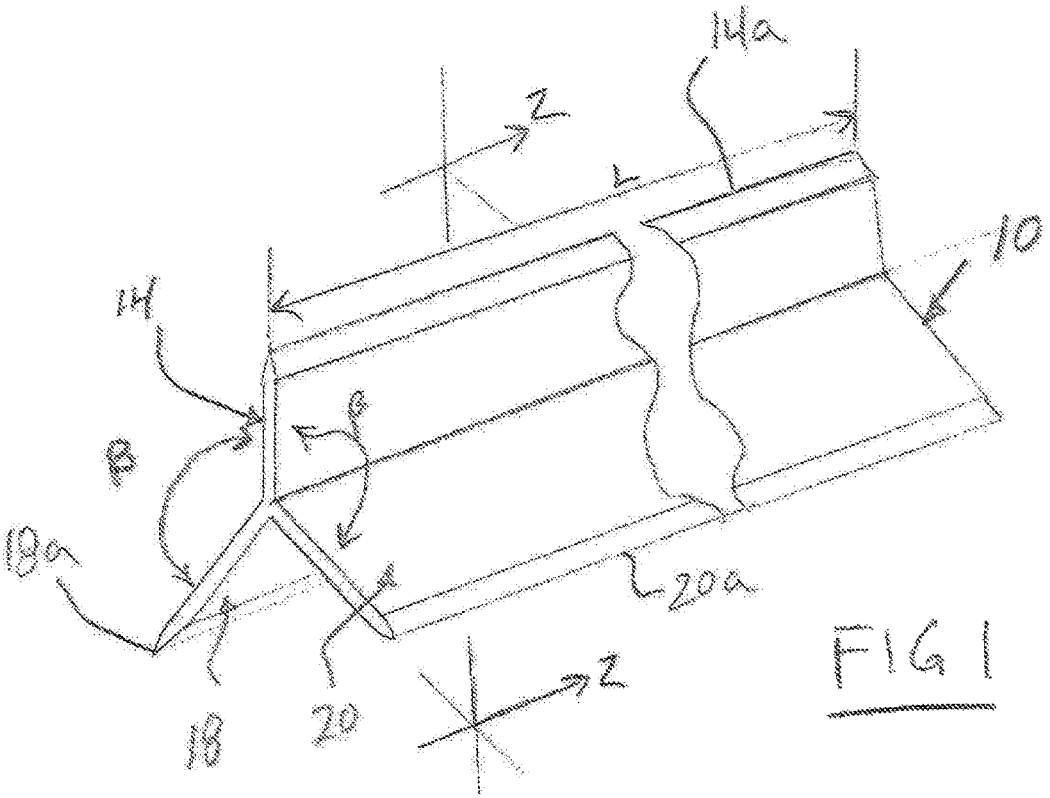
FIG. 1 is a perspective view of a severing device according to the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

The application incorporates by reference U.S. Ser. No. 15/354,228, filed Nov. 17, 2016 and U.S. Provisional Application No. 62/279,314, filed Jan. 15, 2016.

Figure 2:
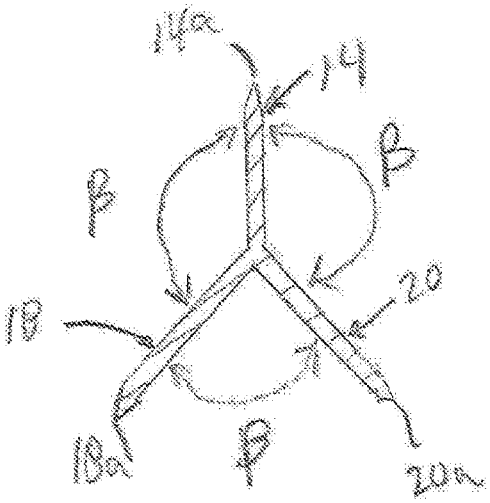
FIG. 2 is a sectional view taken generally along line 2-2 of FIG. 1.

FIGS. 1 and 2 illustrate a severing or dividing device 10 according to a first embodiment of the invention. The severing device 10 has an inverted Y-shaped cross section. It can have a length L of about 9 inched to 12 inches. It is preferably composed of an extruded aluminum construction. Alternately, the severing device could be composed of stainless steel or another metal or hard plastic, or other suitable material. The device can be extrude, welded or of other construction.

The severing device 10 includes an upstanding leg 14 and two downwardly directed legs 18, 20. The leg 14 can have a sharpened edge 14*a*. Likewise the legs 18, 20 can have respective sharpened edges 18*a*, 20*a*, or rounded or blunt edges. If the legs have sharpened edges 18*a*, 20*a*, the severing device can be rotated about its axis to present either of the legs 18, 20 as the upward leg. Thus, if the edge 14*a* becomes dull, either of the legs 18, 20 can alternately be used. According to one embodiment the edges 14*a*, 18*a*, 20*a* can have varying degrees of thickness or sharpness to be used for severing different types of meat or fish. The legs can be oriented at 120 degree angles β from each other.

Figure 2A:
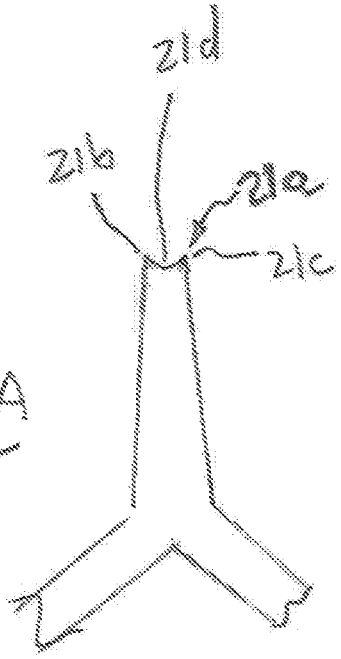
FIG. 2A is a fragmentary, enlarged sectional view of an alternate edge to the severing device of FIG. 1.

FIG. 2A shows an alternate profile to one or more of the edges 14*a*, 18*a*, 20*a* of the severing device 10. For example, an edge 21*a* can have a parallel peak profile with longitudinal edges 21*b*, 21*c*, with a u-shaped trough 21*d* between the edges 21*b*, 21*c*. The use of two edges may help grip the slab being severed to avoid slippage.

FIG. 3 shows a frozen slab 30 of meat or fish oriented on top of the raised edge 14*a* of the leg 14. The legs 18, 20 serve as a base, resting on a kitchen counter 34, table top or the like. A user presses down with his hands H on the slab 30 and on an overhanging portion 38 of the slab 30, on opposite sides of the severing device 10 to break off that portion 38 as shown. The legs 18, 20 tend to spread open on the counter when the used applies a downward force. Spreading of these legs 18, 20 causes the severing device to increase in stability, resisting overturning.

FIG. 4 illustrates an alternate embodiment severing or dividing device 40 that comprises a triangular cross section. This cross section provides three elongated sides 44, 46, 48, having edges 44*a*, 46*a*, 48*a*. These edges 44*a*, 46*a*, 48*a* can have varying sharpness for severing different kinds of meat or fish. The edges may have the profile shown in FIG. 2A. The severing device 40 is used in the same manner as described for FIG. 3. The severing device 40 can have a length L of about 9 inched to 12 inches. It is preferably composed of an extruded aluminum construction. Alternately, the severing device could be composed of stainless steel or another metal or hard plastic, or other suitable material. The device can be extrude, welded or of other construction.

FIG. 5 illustrates a further alternate embodiment severing or dividing device 50 that comprises an inverted T-shaped cross section. This cross section provides three elongated legs 54, 56, 58. The leg 54 has a separating edge 54*a* which can be sharpened. The legs 56 and 58 serve as a base for supporting the severing device on the counter 34 or the like. The severing device 50 is used in the same manner as described for FIG. 3. The severing device 50 can have a length L of about 9 inched to 12 inches. It is preferably composed of an extruded aluminum construction. Alternately, the severing device could be composed of stainless steel or another metal or hard plastic, or other suitable material. The device can be extrude, welded or of other construction.

Figures 6, 7:
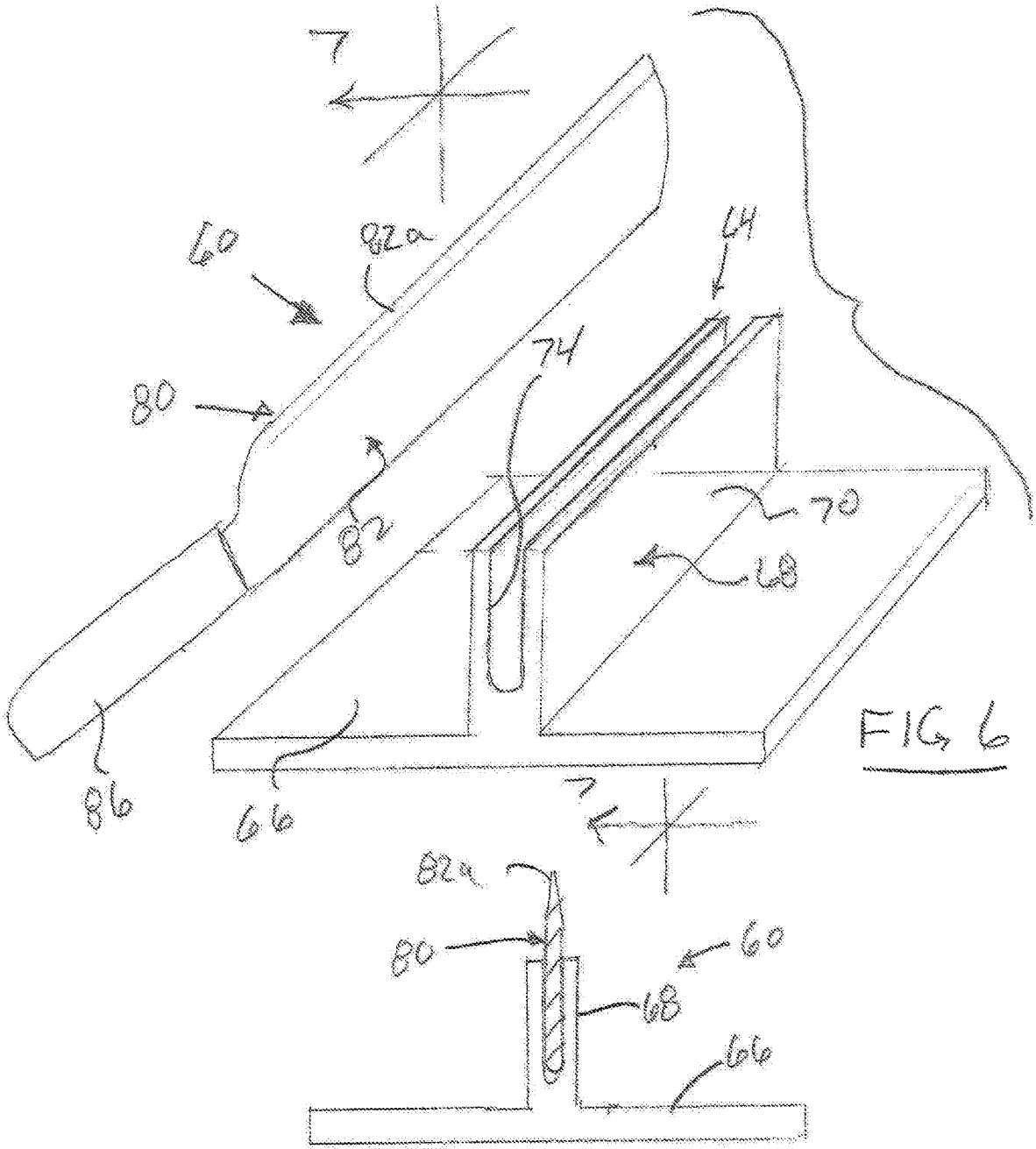
FIG. 6 is an exploded perspective view of an alternate embodiment.
FIG. 7 is a sectional view taken generally along line 7-7 of FIG. 6.

FIGS. 6 and 7 show an alternate embodiment severing or dividing device 60. According to this embodiment a stand 64 includes a base plate 66 supporting a holder 68. The holder includes a vertical wall 70 having an elongated slot 74. A cleaver or knife 80 has a blade 82 with a sharpened edge 82*a*, and a handle 86. The cleaver 80 is placed edge-up into the slot 74. Frozen slabs can then be placed over the edge 82*a* and severed as shown in FIG. 3. The cleaver 80 can be conveniently washed, maintained or replaced, separate from the stand 64.

The severing device stand 64 can have a length L of about 9 inched to 12 inches. It is can be composed of plastic, an extruded aluminum construction, stainless steel or another metal, or other suitable material. The device can be extrude, welded or of other construction.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A method of severing a portion from a slab of meat or fish, comprising the steps of:

providing an elongated body providing a base for being supported on a surface and a raised edge portion supported from the base;

the base sized and configured to resist overturning of the body when force is applied onto the raised edge portion to sever a portion from a slab of meat or fish; and placing a slab of meat or fish onto the raised edge portion with a portion to be severed on one side of the raised edge portion and a remainder of the slab on an opposite side of the raised edge portion; and applying a downward force on the portion to be severed while holding the remainder down.

2. The method according to claim 1, wherein the base comprises two legs of an inverted Y-shaped cross section.

3. The method according to claim 1, wherein the base comprises a flat surface.

4. The method according to claim 1, wherein the body has an inverted Y-shaped cross section.

5. The method according to claim 1, wherein the body has a triangular cross section.

6. The method according to claim 1, wherein the body has an inverted T-shaped cross section.

7. The method according to claim 1, wherein the body is composed of stainless steel.

8. The method according to claim 1, wherein the body is composed of aluminum.

9. The method according to claim 1, wherein the body is composed of plastic.

10. The method according to claim 1, wherein the device has a length of between 9 inches and 12 inches.

11. The method according to claim 1, wherein the raised edge portion comprises a groove for holding a separate cutting blade with the blade facing upward.

12. The method according to claim 1, wherein the raised edge portion comprises twin edges separated by a groove.

13. A method of severing a portion from a frozen food piece, comprising the steps of:

providing an elongated body providing a base for being supported on a surface and a raised edge portion supported from the base;

the base sized and configured to resist overturning of the body when force is applied onto the raised edge portion to sever a portion from a frozen food piece; and placing a frozen food piece onto the raised edge portion with a portion to be severed on one side of the raised edge portion and a remainder of the frozen food piece on an opposite side of the raised edge portion; and applying a downward force on the portion to be severed while holding the remainder down.

14. The method according to claim 13, wherein the base comprises two legs of an inverted Y-shaped cross section.

15. The method according to claim 13, wherein the base comprises a flat surface.

16. The method according to claim 13, wherein the body has an inverted Y-shaped cross section.

17. The method according to claim 13, wherein the body has a triangular cross section.

18. The method according to claim 13, wherein the body has an inverted T-shaped cross section.

19. The method according to claim 13, wherein the raised edge portion comprises a groove for holding a separate cutting blade with the blade facing upward.

20. The method according to claim 13, wherein the raised edge portion comprises twin edges separated by a groove.

* * * * *